United States Patent [19]

Nadezhdin

[11] Patent Number: 4,756,837

[45] Date of Patent: Jul. 12, 1988

[54] WET, PRESSURE, PARTIAL OXIDATION OF BLACK LIQUOR

[75] Inventor: Alex Nadezhdin, Beaconsfield, Canada

[73] Assignee: Domtar Inc., Montreal, Canada

[21] Appl. No.: 36,504

[22] Filed: Apr. 9, 1987

[51] Int. Cl.[4] ..... C02F 1/74; D21C 11/14

[52] U.S. Cl. ..... 210/761; 210/928; 162/16; 162/29; 162/189

[58] Field of Search ..... 210/761, 762, 928; 162/16, 29, 30.1, 30.11, 31, 35, 38, 45, 189

[56] References Cited

U.S. PATENT DOCUMENTS

| | | | |
|---|---|---|---|
| 2,665,249 | 1/1954 | Zimmermann | 210/2 |
| 2,774,666 | 12/1956 | Barton et al. | 92/2 |
| 3,806,403 | 4/1974 | Ferguson | 210/928 X |
| 3,833,463 | 9/1974 | Croom | 210/928 X |
| 3,870,631 | 3/1975 | Fassell et al. | 210/63 |
| 3,876,497 | 4/1975 | Hoffman | 210/761 X |
| 3,920,506 | 11/1975 | Morgan | 210/761 X |
| 4,017,421 | 4/1977 | Othmer | 210/761 X |
| 4,058,433 | 11/1977 | Fuller et al. | 210/928 X |

FOREIGN PATENT DOCUMENTS

| | | | |
|---|---|---|---|
| 555460 | 4/1958 | Canada . | |
| 622663 | 6/1961 | Canada . | |
| 962012 | 2/1975 | Canada | 9/36.6 |
| 977621 | 11/1975 | Canada | 110/7 |
| 1010164 | 5/1977 | Canada | 362/15 |
| 1087129 | 10/1980 | Canada | 202/79 |

OTHER PUBLICATIONS

"The Zimmermann Process in Soda Pulp Mill Recovery Systems", J. E. Morgan and C. M. Saul, Appita, vol. 22, No. 3 (Nov. 1968).

"The Wet Air Oxidation (WAO) of Waste", D. F. Othmer, Mechanical Engineering (Dec. 1979), pp. 30–37.

*Primary Examiner*—Tom Wyse

[57] ABSTRACT

A wet, pressure, partial oxidation process to favor the partial oxidation of black liquor obtained from soda pulping. This is obtained by adjusting the equivalent of sodium ion content of a soda pulping black liquor within the range of about 21 to 26 weight % based on the total weight of the dissolved black liquor solids. This adjustment favorably reduces lignin fragments into short chain organic acids and thereby increases their production. In the case of potassium, the adjustment of the sodium content is carried out using an equivalent amount of a molar basis of potassium ion. A product wherein the amount of short chain organic acid salts is between 70 and 90%, the amount of aromatic lignin fragments and aromatic products thereof is between 0 and 10% and sodium carbon/bicarbonate mixture constitutes not more than 20% on the dry solids basis is also disclosed.

11 Claims, 2 Drawing Sheets

□ EXAMPLE 5
+ SAMPLE B
24% Na in feed solids
19% Na in feed solids
SHORT CHAIN ANIONS CONC. M
3
2.8
2.6
2.4
2.2
2
1.8
1.6
1.4
1.2
1
0.8
0.6
0.4
FEED
1
2
3
4
DISCHARGE
COMPARTMENT NUMBER

WET, PRESSURE, PARTIAL OXIDATION OF BLACK LIQUOR

FIELD OF THE INVENTION

This invention relates to the wet, pressure, partial oxidation process of soda pulping black liquor, in order to favour the formation of short chain organic acids. This invention is preferably directed to a process and to a product wherein the amount of lignin fragments is preferably converted into short chain organic acid products which are maximized.

BACKGROUND OF THE INVENTION

The principle of wet combustion has been known for many years. Wet combustion of pulping black liquors with air or oxygen under pressure is a subject of numerous open literature publications and patent applications since late 1940's. Among them: U.S. Pat. No. 2,665,249 dated Jan. 5, 1954 and Canadian equivalent No. 622,663 dated June 27, 1961 as invented by F. J. Zimmerman, U.S. Pat. No. 2,774,666 dated Dec. 18, 1956 and its Canadian equivalent No. 555,460 dated Apr. 1, 1958 as invented by E. W. Schoeffel and D. M. Barton. There is also Canadian Pat. No. 962,012 as invented by Pradt et al, Morgan and Saul's "The Zimmerman Process in Soda Pulp Mill Recovery Systems" Appita Vol. 22, No. 3 (November 1968) and Othmer, "The Wet Air Oxidation (WAO) of Waste", Mechanical Engineering (December 1979) p. 30–37.

Basically the same process has been carried out under various conditions with respect to temperature, pressure and oxidizing gas.

Various types of reactors have been proposed, including for instance: pipeline (as invented by E. L. Cole in Canadian Pat. No. 1,010,164 dated 77/05/10), continuous autoclave (as invented by W. M. Fassell et al in Canadian Pat. No. 977,621 dated Nov. 11, 1975 and U.S. Pat. No. 3,870,631 dated Mar. 11, 1975) or system of batch autoclaves (as invented by D. F. Othmer in Canadian Pat. No. 1,087,129 dated 80/10/07).

Most of the patents consider a complete oxidation of organic material for inorganic salts recovery and/or waste solution safe disposal. Nevertheless in a number of patents an incomplete combustion to make and recover short chain organic molecules such as carboxylic acids anions (e.g. acetate) is discussed.

In Canadian Pat. No. 1,087,129 dated Oct. 7, 1980 Othmer discloses various aspects of the carrying out of such oxidation. It is also known in a general way that oxidation can be total or partial depending upon the reaction conditions, and that it involves various side reactions: For instance, in partial oxidation the complete oxidation of some reactants is obtained, together with little or no oxidation of some other reactants.

Soda black liquor is produced as a result of high yield pulping process using soda ash, that is $Na_2CO_3$, as a main pulping chemical.

The dissolved solids in the soda black liquor include three major classes of components, namely:

1. Lignin fragments of anionic nature, (also known as alkali lignins) from large polymeric fragments down to phenolates, such as vanilate etc, constitute about a half of the dissolved solids weight.
2. Close to 40% of the dissolved solids are accounted for by the short chain hydroxy and carboxy acid anions such as lactate, acetate, propionate, citrate, formate, etc.
3. Sodium carbonate or bicarbonate, depending on pH constitutes from 0 to 10% of the liquor.

Normally the amount of sodium ions naturally occuring in the black liquor obtained by soda pulping process corresponds to less than 20% of the total solids weight. In order to efficiently recover a desired product mixture and avoid problem associated with separation and disposal of high molecular weight by-products, the destruction of first group components must be as complete as possible by the end of the oxidation process without increasing the rate of short chain component destruction. For example: an increase in temperature shortens the time for aromatic lignin fragments decomposition but at the same time increases the rate of short chain components destruction. A decrease in the process temperature would lead to a less extensive destruction of the high molecular weight components within practically acceptable retention time.

Prior art recommends only interruption of oxidation when acetate concentration reaches its maximum thereby creating the necessity of further lignin separation steps. The various equilibria among the three major classes of components in soda black liquor as described above create serious difficulties when one wishes to favour short chain components formations such as acetate and the like.

BRIEF SUMMARY OF THE INVENTION

Applicant has now found a wet, pressure, partial oxidation process to favour the partial oxidation of black liquor obtained from soda pulping comprising adjusting the equivalent of sodium ion ($Na^+$) content of soda pulping black liquor to within the range of about 21 to 26 weight %, preferably 23–24%, based upon the total weight of the dissolved black liquor solids to favourably reduce lignin fragments into short chain organic acids and thereby increase their production, said adjustment in sodium content being carried out in the case of potassium with an equivalent amount on a molar basis of potassium ion.

In the drawings which illustrate preferred embodiments of the invention:

PREFERRED WAY OF CARRYING OUT THE INVENTION

Figure 1:
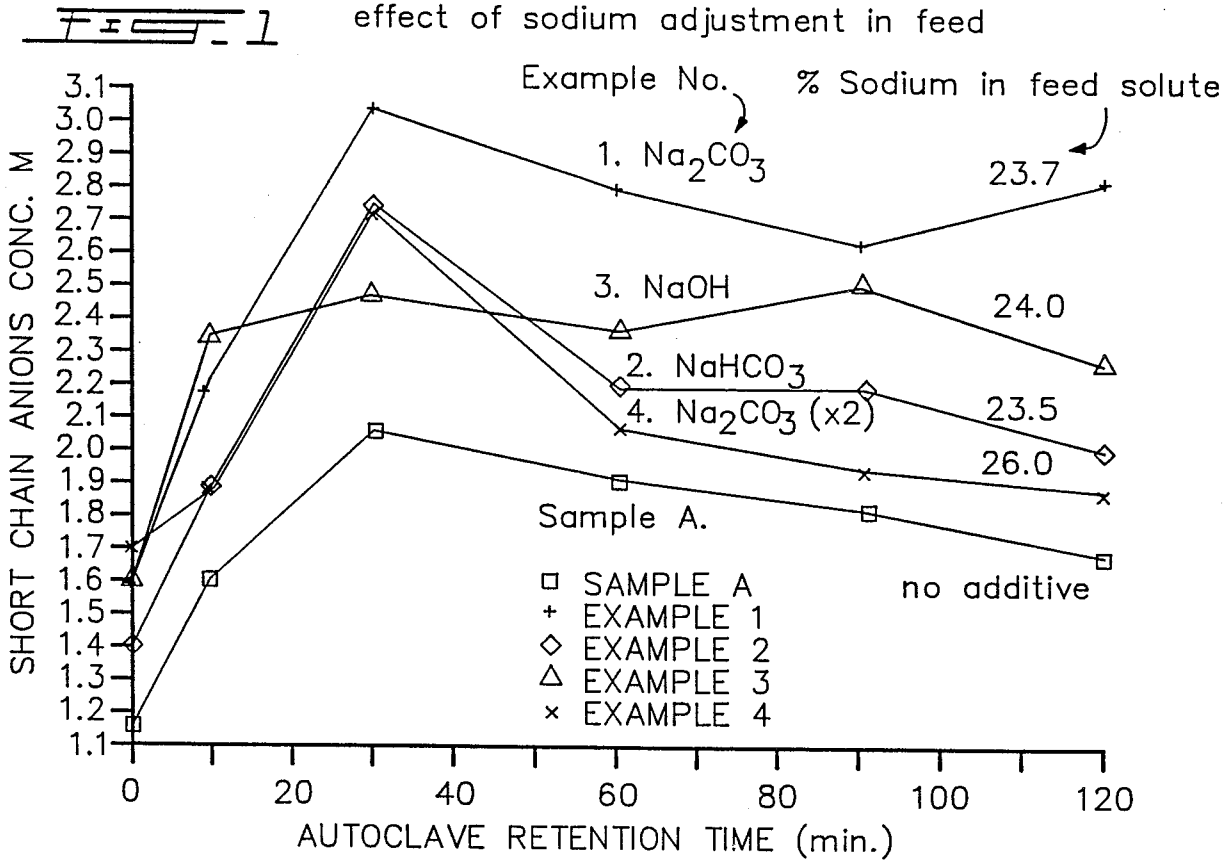
FIG. 1 is a set of graphs as obtained from Examples 1, 2, 3 and 4, compared against a graph obtained in accordance with prior art: Sample A, wherein the molar concentration of the anions of short chain organic acids are plotted over time with sodium adjustment of the feed (Examples) and in accordance with the prior art (Sample A), using batch autoclave oxidation process.

In a preferred way of carrying out the invention, applicant has found that one should target the adjustment of sodium content of soda pulping black liquor to the 23–24% range of the total dissolved solids via addition of $Na_2CO_3$, which would increase the yield of short chain carboxylic acids anions by up to 50% upon complete destruction of aromatic alkali lignin components. In general, adjusting the sodium content of soda pulp does not significantly affect the rate of destruction of the aromatic alkali lignin components.

Other alkali materials such as NaOH or $NaHCO_3$ may also be used but are generally less preferred. Potassium containing alkali material such as $K_2CO_3$ and KOH, may be successfully used to produce beneficial effect on the yield of the desired product instead of sodium alkali in the equivalent quantity on a molar basis, i.e. one molar equivalent of $K^+$ instead of one molar equivalent of $Na^+$.

Applicant has also found a product obtained by the process of claim 1 wherein the amount of short chain organic acid salts is between 70 and 90%, the amount of aromatic lignin fragments and aromatic products thereof is between 0 and 10% and sodium carbonate/bicarbonate mixture constitutes not more than 20% on the dry solids basis.

PREFERRED WAY TO CARRY OUT THE INVENTION

The reaction temperature at which the reaction is preferably conducted was targeted to 200°-210° C. although a variation of ±10° C. may be used if desired: higher temperatures generally increasing chain fractures, and lower reducing them.

In order to recover product solution in a concentrated form amenable for further processing it is preferable to conduct pressure oxidation on highly concentrated black liquor: This may be obtained by removing the excess heat generated by the chemical reaction thereby allowing a large proportion of water to evaporate.

Pressure oxidation of black liquor containing up to 24% of total dissolved solids is preferred, however it must be borne in mind that at that level of the solute concentration, solubility and mass transfer of oxygen may inpinge upon the reaction rates as limiting factors.

Total pressure of the order of 300 to 600 is generally used: 500 to 600 with air and preferably 550 psig is generally sufficient with compressed air as an oxidant. Correspondingly lower total pressure may be employed in the case of pure oxygen or oxygen enriched air, as long as, satisfactory mass transfer is obtained: for pure oxygen it is generally in the range of 300–350 psig and for $O_2$ enriched air it is between pure oxygen and air. In general, higher total pressure negatively affect process economics and may be less favorable for short chain organic acids production.

EXAMPLES

The following will serve to illustrate particular embodiments of the invention.

EXAMPLES 1 to 4

Batch autoclave tests were conducted under 600 psig total pressure, using compressed air as an oxidant. The temperature was 210° C. (410° F.), and a total retention time of 120 minutes was used. The initial black liquor solute concentration (before sodium addition) was 23±1% by weight. In Examples 1 to 3 alkali was added as shown in Table 1, as opposed to no addition (Sample A).

TABLE 1

| | Feed Solution Characteristics | | | | |
|---|---|---|---|---|---|
| | Example Number | | | | Sample |
| | 1 | 2 | 3 | 4 | A |
| Nature of Alkali additive added | $Na_2CO_3$ | $NaHCO_3$ | NaOH | $Na_2CO_3$ | none |
| Amount | 44 | 65 | 34 | 80 | n/a |

TABLE 1-continued

| | Feed Solution Characteristics | | | | |
|---|---|---|---|---|---|
| | Example Number | | | | Sample |
| | 1 | 2 | 3 | 4 | A |
| added (g/l) | | | | | |
| Sodium content of feed solids after adjustment | 23.7 | 23.5 | 24 | 26 | 17 |

RESULTS AND DISCUSSION

The collective molar concentration of the short chain acid anions in solution versus time of oxidation demonstrates the effect of a critical amount of additives on the product yield: That value may be determined using various known direct analytical techniques, such as for example ion chromatography, HPLC (high precision liquid chromatography) or indirect methods based upon calculations from other known solution characteristics.

Samples of solution taken at different times during pressure oxidation experiments were analyzed by techniques and methods referred to in the above paragraph and the results are shown in Table 2 and illustrated by graphs in FIG. 1: The product obtained consisted of short aliphatic acids containing up to 4 carbon atoms, carbonate and alkali lignin (aromatic fragments) as indicated in Table 2.

TABLE 2

SHORT CHAIN ANIONS CONCENTRATION AND OVERALL PRODUCT YIELD IN THE BATCH AUTOCLAVE TESTS

| | Example No. | | | | Sample |
|---|---|---|---|---|---|
| | 1 | 2 | 3 | 4 | A |
| | Short chain anions concentration, Molar | | | | |
| Sample time (minutes) | | | | | |
| 0 | 1.60 | 1.39 | 1.59 | 1.69 | 1.16 |
| 10 | 2.22 | 1.89 | 2.35 | 1.87 | 1.62 |
| 30 | 3.03 | 2.76 | 2.48 | 2.73 | 2.06 |
| 60 | 2.80 | 2.19 | 2.36 | 2.06 | 1.91 |
| 90 | 2.63 | 2.19 | 2.50 | 1.93 | 1.82 |
| 120 | 2.81 | 2.10 | 2.27 | 1.87 | 1.68 |
| Total product recovery as a % of feed solid | 88.7 | 83.8 | 84.7 | 82.4 | 70.1 |
| % of salts of short chain acids in the product solute | 83.7 | 66 | 72.7 | 56.4 | 85.0 |
| % carbonate in the product solute | 11.8 | 17.8 | 18.0 | 30.0 | 6.0 |
| % alkali lignin (aromatic fragment) in the product solute (by difference) | 4.5 | 12.8 | 9.3 | 11.6 | 9.0 |
| Yield of salts of short chain acids as a % of black liquor solids less Na salt | 85.2 | 73.9 | 69.0 | 61.3 | 59.6 |

The results and graphs illustrate a significant improvement of short chain anions formation over time in the presence of critical amount of additional source of sodium cations such as $Na_2CO_3$, NaOH and the like. This conclusion can easily be made by comparing the yield of short chain acids salts based on the initial black liquor solids prior to sodium level adjustment at the bottom of Table 2.

At the same time, if the sodium content of the dissolved solids exceeds a preferred range as shown from Example 4, the beneficial effect of alkali addition becomes less pronounced.

In summary, soda black liquor studied in that series of batch pressure oxidation experiments naturally contained only 17% Na in the total dissolved material. The increase in the sodium content of solution to at least 21%, preferably 23–24% of the dissolved solids using $Na_2CO_3$, NaOH and $NaHCO_3$ produces a noticeable increase in the short chain anions recovery in the following order of additives $Na_2CO_3$>NaOH>$NaHCO_3$> none, as shown in FIG. 1. Adjusting of the level of sodium in the soda black liquor solids within the range of about 21 to 26%, and preferably 23–24% using alkali addition results in a drastically improved yield of short chain anions upon the complete destruction of alkali lignins, as shown in FIG. 1 (by comparing graphs of Example 1 and of Sample A).

It has also been found that the beneficial effect of the soda addition reaches its maximum at 23–24% sodium content of the black liquor solids, and it tends to diminish beyond that level as evidenced from Examples 1 and 4 in Table 2 and FIG. 1.

EXAMPLE 5

Continuous autoclave tests were conducted under steady state conditions at 210° C. (410° F.), using compressed air as an oxidant. In the following experiments, pressure oxidation of black liquor was carried out continuously in a flow through pilot scale four compartments autoclave under conditions similar to batch tests. Sodium was added in the form of $Na_2CO_3$.

TABLE 3

Feed solution characteristics in the continuous autoclave tests

| | Experiment number 5 | Sample B |
|---|---|---|
| Initial black liquor, % solute concentration | 24 | 22 |
| % sodium in the feed solute | 24 | 19 |

Upon reaching the steady state regime of operation, the solution samples were taken simultaneously from the feed tank, all four compartments and the discharge tank.

RESULTS AND DISCUSSION

Figure 2:
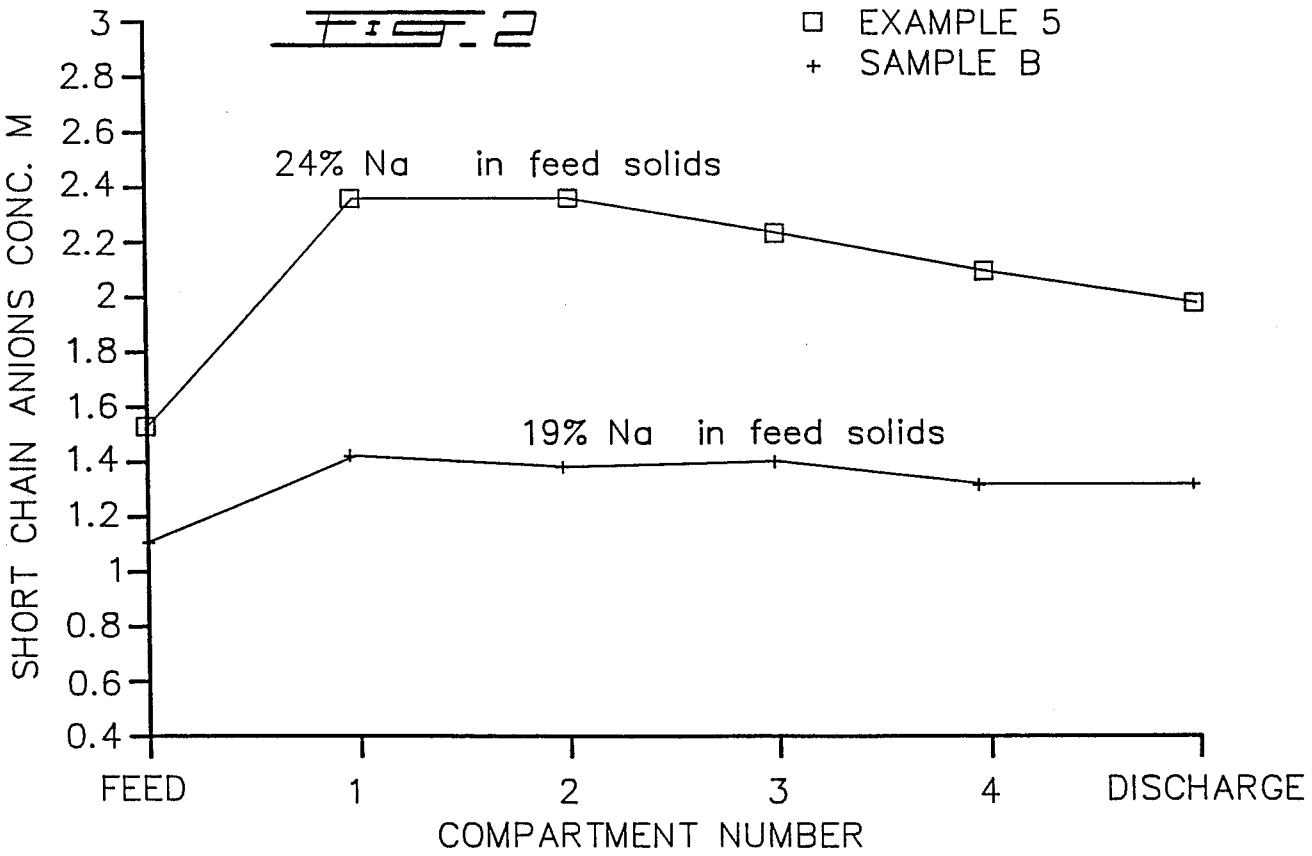
FIG. 2 is a set of graphs representing short chain anions concentration profiles along a continuous autoclave operating in a steady state regime, for sodium content of the black liquor solids of 19% (Sample B) and 24% (Example 5).

The short chain anions concentrations found in solution samples represent the autoclave profile corresponding to the ordinary, concentration vs time, kinetics of batch autoclave tests. The data obtained are listed in Table 4 and are shown in FIG. 2.

The overall product recovery as a % of feed solids and product composition are given in Table 4.

Again the beneficial effect of sodium content adjustment is clearly demonstrated.

TABLE 4

SHORT CHAIN ANIONS CONCENTRATIONS AND OVERALL PRODUCT YIELD IN THE CONTINUOUS AUTOCLAVE TESTS

| | Example Number 5 | Sample B |
|---|---|---|
| | Short chain anions concentration, M | |
| Sample taken from: | | |
| Feed | 1.50 | 1.1 |
| Comp. 1 | 2.38 | 1.41 |
| Comp. 2 | 2.38 | 1.38 |
| Comp. 3 | 2.24 | 1.40 |
| Comp. 4 | 2.09 | 1.30 |
| Discharge | 1.97 | 1.31 |
| Total product recovery as a % of feed solids | 75.2 | 60.1 |

TABLE 4-continued

SHORT CHAIN ANIONS CONCENTRATIONS AND OVERALL PRODUCT YIELD IN THE CONTINUOUS AUTOCLAVE TESTS

| | Example Number 5 | Sample B |
|---|---|---|
| | Short chain anions concentration, M | |
| % of salts of short chain acids in the product solute | 74.1 | 77.3 |
| % carbonate in the product solute | 16.0 | 10.4 |
| Yield of salts of short chain acids as a % of black liquor solids less Na salt adjustment | 64.7 | 46.5 |
| Recovery of short chain acids salts as % of total feed solids | 55.7 | 46 |

EXAMPLE 6

An auxiliary batch autoclave test was conducted using potassium carbonate, $K_2CO_3$. The conditions and starting solution concentration were identical to those of Example 1, except that, instead of 44 g/l $Na_2CO_3$, 57 g/l $K_2CO_3$ was used. The overall product recovery as a % of feed solids was 82%, substantially higher than 70% yield of Sample A experiment representing prior art.

In the above examples, the rate of aromatic lignin fragments destruction was found to be practically independent of the nature or the amount of the additives. By the end of each test the aromatics content of the end solution was generally within 15% and in a preferred range of conditions within 10% of the total dissolved solids. The carbonate/bicarbonate salts constituted not more than 30% and in the case of preferred conditions (Examples 1 and 5) not more than 15% of the total dissolved solids. The rest, i.e. 70% plus of the product were salts of short aliphatic acids.

On the basis of these examples, one can easily see that pressure oxidation of soda black liquor with the purpose of maximizing recovery of short chain carboxylic acid salts upon a complete oxidation of alkali lignins should preferably be conducted in the following manner. Extra sodium should be added if necessary to the feed solution in the form of NaOH or $Na_2CO_3$ (preferrably the latter) in order to have % sodium of the dissolved matter most preferably in the 23–24% range.

In a particular embodiment, the product as obtained in accordance with this invention, has a weight ratio of aliphatic acids salts to aromatic components of no less than 10:1 while the weight ratio of aliphatic acids salts to sodium carbonate/sodium bicarbonate mixture is no less than 7:1. When potassium is present, part of the sodium carbonate/sodium bicarbonate is replaced with the equivalent amount of a molar basis of potassium.

Potassium can be used instead of sodium in the equivalent quantity on the molar basis.

Having described the invention, modifications will be evident to those skilled in the art without departing from the spirit of the invention, as defined in the appended claims.

I claim:

1. In a process involving a wet, pressure, partial oxidation of black liquor to favour short chain aliphatic acid formation the improvement comprising: (a) taking a black liquor obtained from a soda pulping process, (b)

adjusting with at least one member of the group consisting of sodium carbonate, sodium hydroxide, sodium bicarbonate, potassium hydroxide and potassium carbonate the equivalence of sodium ion content of said black liquor within the range of about 21 to 26 weight % based on the total weight of the dissolved black liquor solids, said sodium equivalence being the sum of the weight % of sodium ions present plus 23/39 of the weight % of potassium ions present (c) carrying out at a temperature between 190° to 220° C. pressure oxidation of said black liquor with oxygen or its equivalent to obtain salts of short chain aliphatic acids and incompletely oxidized aromatic lignin fragments, and thereby increasing the production of said salts of short chain aliphatic acids and correspondingly reducing the content of said aromatic lignin fragments.

2. The pressure oxidation as defined in claim 1 wherein step (b), said at least one member is sodium carbonate.

3. The pressure oxidation process as defined in claim 1 whereby in step (b), sodium carbonate is used for adjusting said sodium ion content of said black liquor within the range of 23–24%.

4. The pressure oxidation process as defined in claim 1, whereby in step (c), the pressure oxidation process is carried out at a pressure of 550 psig±10%, said temperature is between 200°–210° C. and said oxygen or its equivalent is fed into the solution at a minimum amount of 50% by weight of the initial feed solids.

5. The pressure oxidation process as defined in claim 1 wherein step (b), said at least one member is NaOH.

6. The pressure oxidation process as defined in claim 1 wherein step (b), said at least one member is $NaHCO_3$.

7. The pressure oxidation process as defined in claim 1 wherein step (b), said at least one member is KOH.

8. The pressure oxidation process as defined in claim 1 wherein step (b), said at least one member is $K_2CO_3$.

9. The product obtained by the process of claim 1 wherein, in said product the amount of salts of short chain aliphatic acids is between 70 and 90%, the amount of aromatic lignin fragments and aromatic products thereof is between 0 and 10%, and wherein a sodium carbonate/sodium bicarbonate mixture is present and constitutes not more than 20% on the dry solids basis.

10. The product as defined in claim 9 wherein the weight ratio of salts of short chain aliphatic acids to aromatic lignin fragments is no less than 10:1 while the weight ratio of salts of short chain aliphatic acids to sodium carbonate/sodium bicarbonate mixture is no less than 7:1.

11. The product as defined in claim 10 wherein potassium is present and part of the sodium carbonate/-sodium bicarbonate is replaced with an equivalent amount of a molar basis of potassium.

* * * * *